United States Patent [19]

Broemel, Jr.

[11] Patent Number: 4,827,809

[45] Date of Patent: May 9, 1989

[54] COMPATIBLE EXTENSION TIP FOR AN AIR RATCHET ADAPTOR

[76] Inventor: Lloyd F. Broemel, Jr., P.O. Box 1086, Denham Springs, La. 70726

[21] Appl. No.: 83,030

[22] Filed: Aug. 7, 1987

Related U.S. Application Data

[63] Continuation-in-part of Ser. No. 858,661, May 2, 1986, Pat. No. 4,735,118.

[51] Int. Cl.[4] ..... B25B 21/00

[52] U.S. Cl. ..... 81/57.3; 81/57.29; 81/57.13; 81/57.14

[58] Field of Search ..... 81/57.3, 57.29, 177.1, 81/177.2, 180.1, 185.2, 57.13, 57.14

[56] References Cited

U.S. PATENT DOCUMENTS

| | | | |
|---|---|---|---|
| 1,385,214 | 7/1921 | Klopper | 81/57.29 X |
| 1,494,200 | 5/1924 | Waters | 81/57.29 |
| 1,875,529 | 9/1932 | Vandervoort | 81/57.29 X |
| 3,987,691 | 10/1976 | Savage | 81/57.3 |
| 3,987,692 | 10/1976 | Lesner et al. | 81/57.29 X |
| 4,171,651 | 10/1979 | Dacunto | 81/57.29 |
| 4,287,795 | 9/1981 | Curtiss | 81/57.3 X |
| 4,322,989 | 4/1982 | Garolis | 81/57.13 |

FOREIGN PATENT DOCUMENTS

| | | | |
|---|---|---|---|
| 2016352 | 10/1971 | Fed. Rep. of Germany | 81/57.29 |
| 2056348 | 3/1981 | United Kingdom | 81/57.3 |

*Primary Examiner*—Debra Meislin

[57] ABSTRACT

An extension tip, for an air ratchet adapteor, having an elongated housing which is closed on one end and open at the opposite end. The housing is hollow except for a driven gear and optional idler gears at the closed end. The driven gear includes a hexagonal aperture to accept internal removable sockets. The driven gear or optional idler gear is engaged with the gear housing idler gear of the air ratchet adaptor when the extension tip is attached to the air ratchet adaptor. The open end of the housing has a tensioned retaining clip situated on both sides of the opening for engaging with the recesses of the gear housing of the air ratchet adaptor to hold the extension tip firmly in place. An inner gear housing stop is located internally next to the driven gear or the optional idler gear of the closed end. The extension tip also includes a top and bottom recess which allow for passage of the support pin heads while the extension tip is being attached to the air ratchet adaptor. The extension tip may be formed in varying shapes of which will be the determining factor in the number of idler gears needed, if any. The extension tip symmetry allows for reversible attachment to the air ratchet adaptor. The extension tip, air ratchet adaptor, and the air ratchet connected in combination is suitable for installing and removing fasteners, and applying torque to such, in a limited work space when a stable, controlled one hand operation of a powered tool is needed.

4 Claims, 2 Drawing Sheets

COMPATIBLE EXTENSION TIP FOR AN AIR RATCHET ADAPTOR

This is a continuation-in-part of Ser. No. 858,661, Filed May 2, 1986, now U.S. Pat. No. 4,735,118 granted Apr. 5, 1988.

BACKGROUND OF THE INVENTION

1. Field of the Invention

This invention relates generally to an extensible adaptor to be used in conjunction with a commercially available three-eighths inch drive air ratchet, used by the general public, for installing and removing a wide variety of sizes and kinds of fasteners where work and operating clearance is minimal; and stable one hand operation of the air ratchet/adaptor tool is needed. More specifically, this invention relates to said extensible adaptor in which provision is made for easy, rapid engagement/disengagement of internal sockets, of varying sizes, which do not protrude out of said adaptor beyond said socket's thin retainer flange, thereby keeping work space to a minimum. Particularly, this invention relates to extension tips compatible to the air ratchet adaptor to provide a variety of sizes and shapes to gain access to large and small fasteners in obstructed places.

2. Description of the Prior Art

In a repair or assembly shop, more specifically an automobile repair shop, where the three-eighths inch drive air ratchet is in everyday use, there is a need and requirement for an extensible adaptor to said air ratchet which allows the mechanic to turn fasteners in limited work and operation space. Especially apparent is the need for a variety of sizes of internal removable sockets that utilize minimal work space. The following patents have made attempts to provide a tool for access to limited work space, but all have shortcomings with regard to simplicity and convenience.

U.S. Pat. Nos. 4,374,479 and 4,374,480 do not provide for adequate stability if used with said air ratchet; and both utilize the common protruding sockets, thereby taking up valuable work space. U.S. Pat. No. 4,287,795 is most suited for production lines in the automotive industry wherein the wrench is specifically used for one size fastener. Also U.S. Pat. No. 4,287,795 has an interconnection with the powered tool which is cumbersome and time consuming to attach, thereby limiting its usefulness to the general public.

U.S. Pat. No. 3,027,790 is designated as an adaptor for nuts, bolts, wrenches and the like. More specifically, its purpose is to provide a means to make the various sizes of American and Continental measuring systems interchangeable. More particularly, its split shell design cannot be used as a socket design.

U.S. Pat. No. 4,328,720 provides for a removable socket designed with means to permit engagement by a retention ring. The socket for larger size fasteners has a cylindrical socket end having straight sides which provides a weaker socket design than one with a bevelled surface when used with an air powered ratchet.

U.S. Pat. No. 4,322,989 provides for a tool module to be slideably engaged with a power module. The tool module design is not compatible with a three-eighths inch drive air ratchet.

SUMMARY OF THE INVENTION

The present invention provides a tool which is adaptable to a commercially available three-eighths inch drive, or other size, air ratchet for applying stablized powered torque to fasteners in relatively inaccessible work spaces. The present invention achieves its objectives by providing a handle means for attachment to said air ratchet which drives a gear train in an elongated housing terminating in a driven gear with means to use internal insertable type sockets and tips for a variety of sizes and kinds of fasteners. Extension tips compatible to the air ratchet adaptor are included to provide a variety of sizes and shapes to gain access to large and small fasteners in obstructed places.

It is thus the object of this invention to provide for a gear driven air ratchet adaptor comprising an elongated, flat housing and a handle means which may be simply and quickly attached to said air ractchet. Said air ratchet adaptor provides rigidity and stability when attached to said air ratchet, facilitating one hand operation of the tool.

Further objects include internal, easily engaged/-disengaged sockets for installing and removing fasteners in minimal work space, said sockets having an aperture allowing bolt or threaded shafts to pass through, also having check ball receptors for holding said sockets in place in the driven gear aperture, also having a radially outwardly extending flange on one end to keep it from sliding through the driven gear aperture, also having a radially inwardly extending flange on the opposite end to prevent the fastener head from passing completely through the socket, also having magnets (optional) attached on the upper flange to further facilitate the holding of metallic tips and nuts in order to maintain one hand operation of the tool, also having socket type adaptors for using a variety of screw driver tips, sockets, extensions, the common protruding sockets and such like.

A further object is to provide for a driven gear receptacle which receives the internal socket on either side of said housing thereby allowing for tool operation in multiple directions including the use of forward and reverse directions of the air ratchet.

A further object is to provide for inserts (not shown) for said air ratchet adaptor handle enabling said handle to fit many brands of commercially available air ratchets used by the general public.

A further object is to provide for an alternative elongated housing means (not shown) designed in a circular arc or hingedly adjustable without the loss of tool rigidity.

A further object is to provide for an alternative to said handle (not shown) wherein the air ratchet motor is made as an integral unit with said housing thereby eliminating the air ratchet head and said handle of said air ratchet adaptor while still providing two-way direction to the driven gear.

A further object is to provide for an alternative to said handle wherein the driven gear is eliminated from said elongated housing and housed is a separate extension tip sheath which can be made into a variety of shapes and sizes.

Further objects and advantages of the present invention will become apparent from a consideration of the drawings and ensuing description thereof.

DETAILED DESCRIPTION OF THE INVENTION

Figures 1, 2, 3, 4, 5:
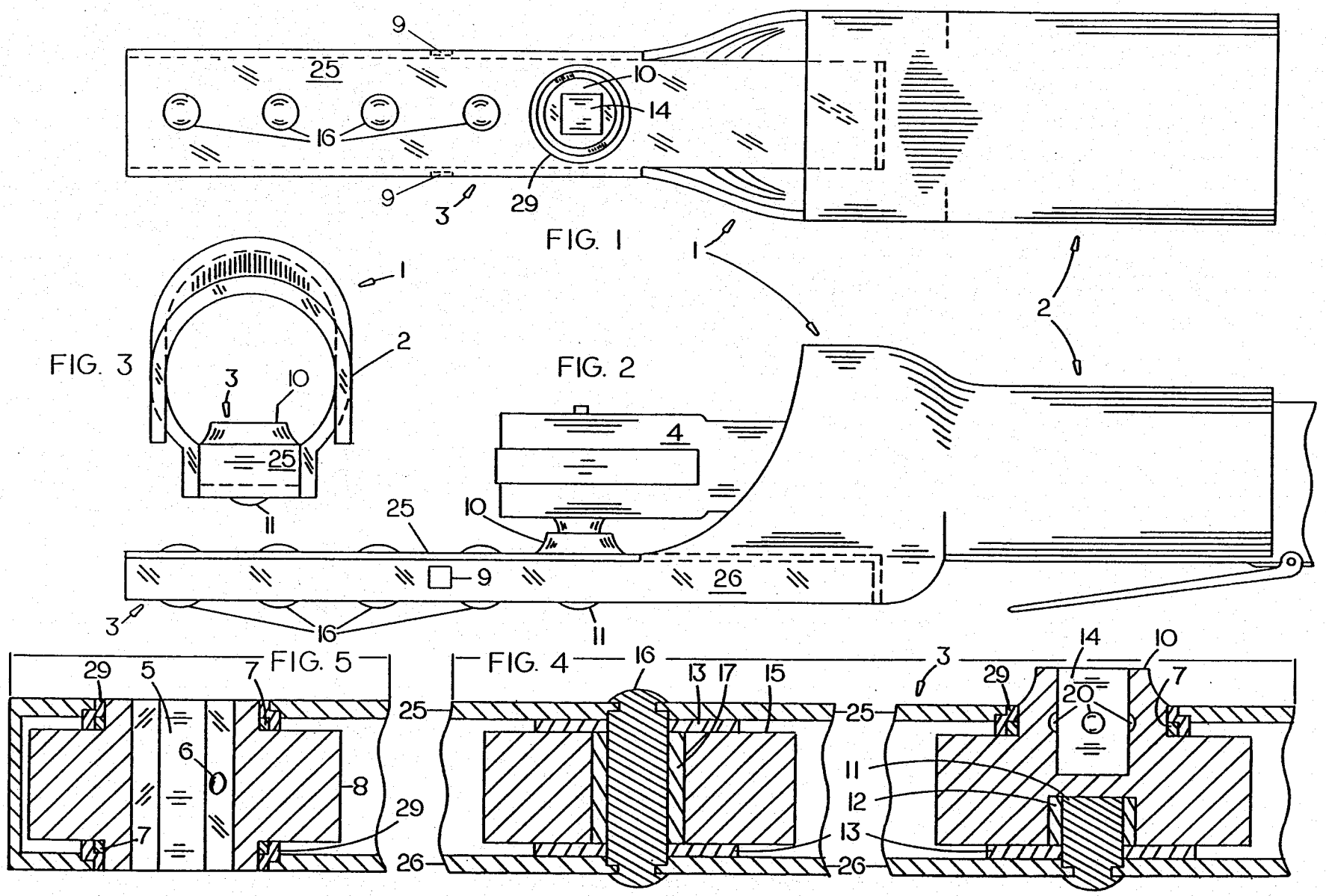
FIG. 1 is a top view of the air ratchet adaptor shown without an air ratchet installed so that the driven gear may be shown.
FIG. 2 is a side view of the air ratchet adaptor connected to a typical three-eighths inch drive air ratchet which is broken away to conserve space.
FIG. 3 is an end view of the handle end of the air ratchet adaptor.
FIG. 4 is an enlarged, fragmented longitudinal cross sectional side view of the gears in the housing of the air ratchet adaptor.
FIG. 5 is an enlarged, fragmented longitudinal cross sectional side view of the driven gear in the extension tip.

Referring now to FIGS. 1 and 2, an air ratchet adaptor according to the present invention is generally designated by the reference numeral 1. The air ratchet adaptor 1 includes a slotted, semi-cylindrical handle 2 which serves as a holder of the commercially available three-eighths inch drive air ratchet 4. Handle 2 is larger at the end attached to housing 3 to allow space for the air ratchet head to pass through the handle 2. The air ratchet head is slid through handle 2 and the air ratchet drive shaft is engaged with square aperture 14 of driving gear 10. A flat, elongated gear housing 3 is preferably fabricated with an upper plate 25 and a lower plate with sides 26 formed integrally into handle 2. Said sides of lower plate 26 protects the gears from dirt and other abrasive materials. The upper plate 25 and lower plate 26 both define suitable aligned openings for support pins, bearings and the like which are contained within housing 3. Said upper plate 25 is a separate plate held in place by the support pins 16 and grooves on the inner walls of handle 2. Stationary support pins 16 provide support for the idler gears 15, while stationary support pin 11 provides support for the driving gear 10. A stepped race and dust seal 29 are situated around the driving gear 10. Squared recess 9 on the side of lower plate 26 receives the tensioned retaining clips 31 of FIG. 8.

Referring now to FIG. 3, an end view of the air ratchet adaptor 1 is shown from the perspective of the end of handle 2. The top of driving gear 10 and lower stationary support pin 11 are shown extending from housing 3. Also shown is the back of upper plate 25 connected to housing 3.

Figures 6, 7, 8, 9, 10, 11:
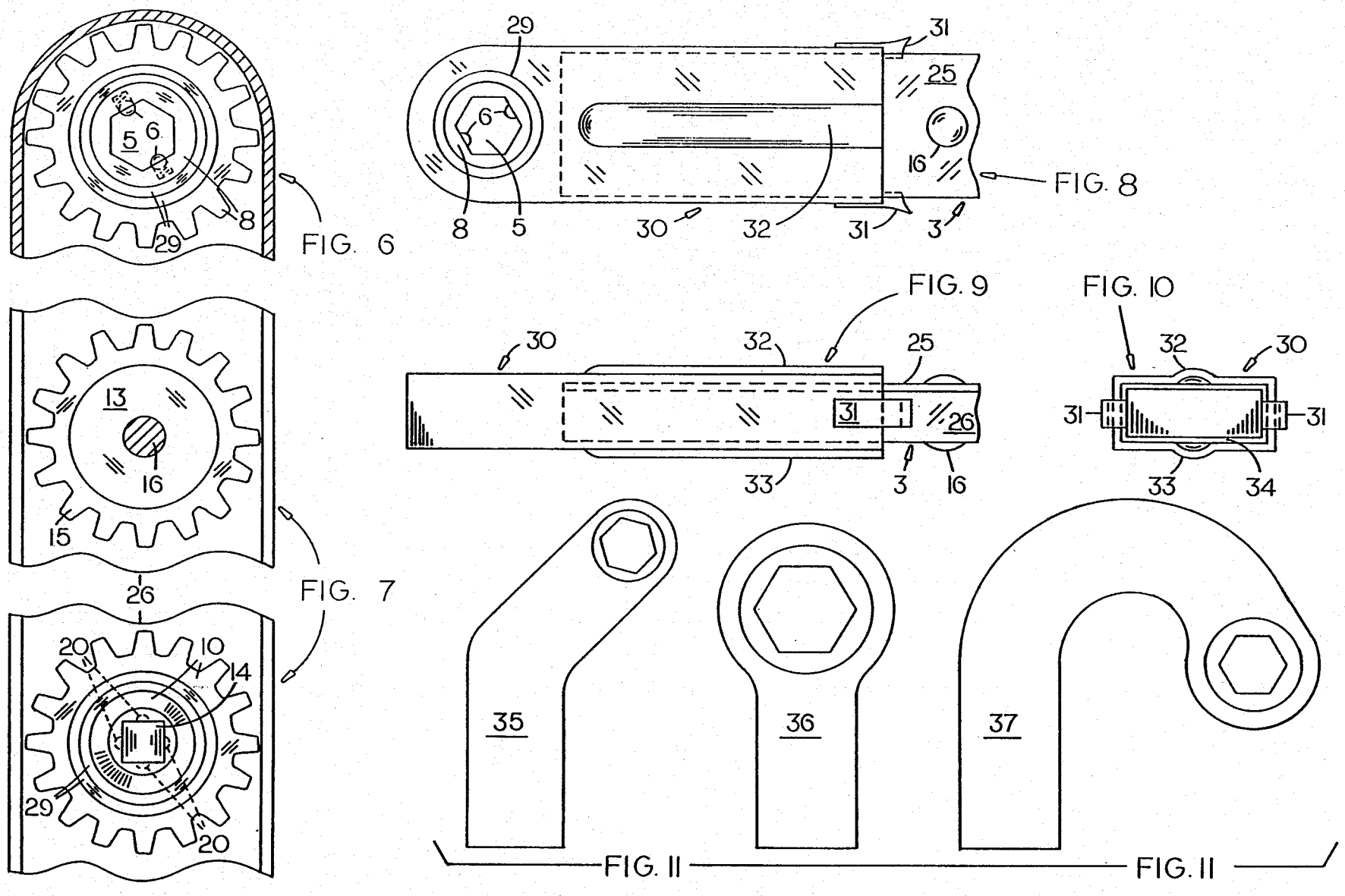
FIG. 6 is an enlarged, fragmented cross sectional tip view of the driven gear in the extension tip.
FIG. 7 is an enlarged, fragmented top view with the top plate removed exposing the gears in the housing of the air ratchet adpator.
FIG. 8 is a top view of the extension tip connected to the air ratchet adapator gear housing which is broken away to conserve space.
FIG. 9 is a side view of the extension tip connected to the air ratchet adaptor gear housing which is broken away to conserve space.
FIG. 10 is an end view of the open end of the extension tip.
FIG. 11 shows three examples of shapes in which the extension tip may be formed.

Referring now to FIGS. 4 and 7, the flat, elongated housing 3 is fragmented and enlarged to show the driving gear 10 and idler gear 15 in detail. The idler gear 15 is disposed upon needle bearing 17 which is rotatably situated upon a stationary supported pin 16. Upper and lower thrust washers 13 are situated between the idler gear 15 and the upper and lower plates 25 and 26. A series of idler gears 15 are driven by a driving gear 10 which has a square aperture 14 to receive the square shaft of air ratchet 4. Said aperture 14 having rounded recesses 20 on all four sides to receive the check ball of the air ratchet drive shaft. Driving gear 10 is situated upon an upper needle bearing 7 with stepped race and dust seal 29 and lower needle bearing 12. Lower needle bearing 12 is rotatably situated upon a stationary support pin 11. A lower thrust washer 13 is situated between the driving gear 10 and lower plate 26.

Referring now to FIGS. 5 and 6, the driven gear 8 is rotatably positioned in a pair of aligned openings in extension tip 30 of FIGS. 8 and 9. About the upper and lower periphery fo driven gear 8 are disposed needle bearings 7 with stepped race and dust seal 29. Driven gear 8 includes an aperture 5 which preferably defines an internal hexagonal, flat surface for receiving internal sockets. On two of the just described surfaces are spring loaded check balls 6 for holding said sockets in place. The gear teeth of driven gear 8 mesh with the teeth of an idler gear 15 in housing 3 of FIG. 4.

Referring now to FIGS. 8 and 9, the elongated extension tip 30 is shown with gear housing 3 in place. Top recess 32 and bottom recess 33 allow for passage of support pins 16 when extension tip 30 is slideably engaged with gear housing 3. Tensioned retaining clips 31 provide a locking mechanism to hold extension tip 30 securely onto housing 3. Hexagonal aperture 5 of driven gear 8 contains two spring loaded check balls 6 for holding the internal sockets in place. A stepped race and dust seal 29 are situated around the driven gear 8. The gear teeth of driven gear 8 of extension tip 30 mesh with the gear teeth of idler gear 15 in gear housing 3 when said gear housing is abutted with inner gear housing stop 34 of extension tip 30. Extension tip 30 adds strength and stability when attached to housing 3. The symmetry of extension tip 30 provides for reversible attachment to housing 3 of air ratchet adaptor 1.

Referring now to FIG. 10, an end view of the extension tip 30 is shown from the perspective of the open end of the extension tip having the tensioned retaining clips 31 for locking onto housing 3.

Inner gear housing stop 34 is a ledge formed into the extension tip 30 sheath, said ledge in said sheath circumventing the section of the teeth of driven gear 8 which is exposed to the open end of extension tip 30. Top recess 32 and bottom recess 33 allow for passage of support pins 16 of FIG. 9 when extension tip 30 is slideably engaged with gear housing 3. Gears are not shown for simplicity.

Referring now to FIG. 11, angled tip 35 allows for securing fasteners disposed in a blind, angled passage or in a location next to both axial and radial ostructions. The oversized head tip 36 provides for fasteners that are larger than aperture 5 of extension tip 30 of FIG. 8. U-shaped tip 37 allows for fasteners to be turned which are directly obstructed. In addition to the driven gear 8, tips 35, 36, and 37 may also contain idler gears 15 as needed.

Operation and attachment of the air ratchet adaptor 1 is straightforward. The end of the air ratchet 4 is passed through handle 2 at the point where the enlarged end of handle 2 and housing 3 meet. The square drive shaft of air ratchet 4 is then inserted into aperture 14 of driving gear 10 while at the same time the air ratchet main body (motor housing) is inserted into handle 2 containing proper handle insert (not shown) of air ratchet adaptor 1. No tools are required for assembly or disassembly. The enlarged part of handle 2 provides space for the head of the air ratchet to pass through and also prevents the tool operator's hand from sliding off the tool during operation. Gear housing 3 is inserted into extension tip 30, 35, 36, or 37 as per application. The extension tip is held in place by the tensioned retaining clips 31. The driven gear 8 of extension tip 30 is meshed with idler gear 15 of housing 3. Proper meshing of gears 8 and 15 is provided by the location of the inner gear housing stop 34. Disengagement of the extension tip 30 is accomplished by spreading the tensioned retaining clips 31 out of recesses 9 of housing 3 and sliding the extension tip 30 off the gear housing 3. The air ratchet supplies rotary power in either a forward or reverse direction to its driving shaft thereby rotating the driving gear 10. From the driving gear 10 power is transferred through the train of idler gears 15 to the driven gear 8. The size and number of said gears may be varied to determine direction of rotation and vary torque and speed. Gears 8, 10, and 15 may be a dry type, or lubricant may be packed within the sealed housing 3. Thrust washers 13 may be of an oil impregnated type. Needle bearings 7, 12, and 17 may be of the permanently lubricated and sealed type.

Internal sockets (not shown) may be slideably engaged into aperture 5 on either side of extension tip 30 providing a choice of up to four actual directions for turning fasteners while operating the air ratchet. Options for use in aperture 5 includes a hexagonal socket with a male square drive shaft to engage with the common protruding sockets, universal joint sockets, and extension shafts. Another option includes a magnetized socket for a variety of tips, as straight blade screwdriver, phillips head, splined, and such like. Molded plastic type slotted, semi-cylindrical inserts (not shown) may be slideably placed into handle 2 thereby making said handle fit many different brands of air ratchets, ninety degree angle drive power units and such like.

The air ratchet adaptor may be manufactured in different sizes to engage with the varying sizes of air ratchets and drives. The air ratchet adaptor housing may also be manufactured with either a circular arc housing or a hingedly adjustable, elongated housing (not shown). The extension tip may be manufactured in other sizes and shapes as needed by the consumer.

It will be obvious to those skilled in the art that various changes may be made without departing from the spirit of the invention and the invention is not to be considered limited to what is shown in the drawings and described in the specifications.

What I claim is:

1. An extension tip for an air ratchet adaptor comprising, in combination:

a. an air ratchet adaptor having a slotted, semicylindrical handle for interconnection with an air ratchet, a gear housing lower plate with sides formed integrally on one end of said handle, said gear housing lower plate includes, in succession from said handle, a driving gear with means for receiving a drive shaft of said air ratchet, and intermediate idler gears, said gears being rotatably mounted on support pins which are in engagement with aligned openings in said gear housing lower plate and an upper plate thus enabling the conveyance of torque to a driven gear means of an extension tip, said one end of said handle being enlarged to allow space for passage of the head of said air ratchet during the mating process, the end of said gear housing lower plate and upper plate which is opposite from said handle being open to allow for exposure of said idler gear to enable said idler gear to mesh with the driven gear of an extension tip, said gear housing lower plate having recess means for receiving a retaining clip of an extension tip, b. an extension tip having an elongated housing, said elongated housing being open at one end and closed at the opposite end, said open end having tensioned retaining clip means for retaining said elongated housing in place when said retaining clip is engaged with said recess means of said gear housing lower plate of said air ratchet adaptor, said closed end having a driven gear means for turning fasteners, said elongated housing having an inner gear housing stop means for correct, constant spacing for the meshing of said driven gear means with said idler gear of said air ratchet adaptor, said elongated housing having recess means for allowing passage of said support pins of said air ratchet adaptor, said elongated housing having symmetry providing reversible attachment to said air ratchet adaptor, and said extension tip in combination with said air ratchet adaptor provides for strength and stability during operation.

2. An extension tip as defined in claim 1, wherein said elongated housing is U-shaped so as to make said extension tip usable to turn fasteners which are directly obstructed, intermediate idler gears to provide correct spacing to mesh with said idler gear of said air ratchet adaptor.

3. An extension tip as defined in claim 1, wherein said elongated housing is angled so as to make said extension tip usable to turn fasteners disposed in a blind, angled passage or in a location next to both axial and radial obstructions, intermediate idler gears to provide correct spacing to mesh with said idler gear of said air ratchet adaptor.

4. An extension tip as defined in claim 1, wherein said elongated housing includes an oversized head and driven gear so as to make said extension tip usable to turn large sized fasteners.

* * * * *